US005366551A

United States Patent [19]

Aidun

[11] Patent Number: 5,366,551

[45] Date of Patent: Nov. 22, 1994

[54] COATING DEVICE FOR TRAVELING WEBS

[75] Inventor: Cyrus K. Aidun, Marietta, Ga.

[73] Assignee: Institute of Paper Science and Technology, Inc., Atlanta, Ga.

[21] Appl. No.: 881,512

[22] Filed: May 12, 1992

Related U.S. Application Data

[63] Continuation-in-part of Ser. No. 849,530, Mar. 11, 1992, abandoned.

[51] Int. Cl.[5] ..... D05C 5/00

[52] U.S. Cl. ..... 118/411; 118/419

[58] Field of Search ..... 118/410, 411, 419; 427/434.2

[56] References Cited

U.S. PATENT DOCUMENTS

| | | | |
|---|---|---|---|
| 3,083,685 | 4/1963 | Colgan | 118/410 |
| 3,113,884 | 12/1963 | Kohler | 118/410 |
| 3,418,970 | 11/1964 | Phelps et al. | 118/410 |
| 3,690,917 | 9/1972 | Herschoff | 118/410 |
| 4,102,299 | 7/1978 | Wallsten | 118/411 |
| 4,250,211 | 2/1981 | Damrau et al. | 427/356 |
| 4,369,731 | 1/1983 | Damrau | 118/410 |
| 4,387,663 | 6/1983 | Aheld | 118/413 |
| 4,453,833 | 6/1984 | Holt | 118/410 |
| 4,643,127 | 2/1987 | Wanke | 118/413 |
| 4,688,516 | 8/1987 | Sommer | 118/410 |
| 4,834,018 | 5/1989 | Sollinger | 118/410 |
| 4,836,134 | 6/1989 | Knop | 118/413 |
| 4,839,201 | 6/1989 | Rantanen et al. | 118/410 |
| 4,858,553 | 8/1989 | Westgard et al. | 118/410 |
| 4,873,939 | 10/1989 | Eskelinen | 118/410 |
| 4,920,913 | 5/1990 | Knop | 118/419 |
| 4,945,855 | 8/1990 | Eklund et al. | 118/410 |
| 5,173,120 | 12/1992 | Suzumura et al. | 118/419 |

OTHER PUBLICATIONS

E. W. Wright, "Modern Coating Application and Blade Metering Systems" TAPPI Seminar Notes, pp. 105–108, 1986.

Beisswanger, et al. "Coating Paper and Board, Practical Experience with the SDTA and LDTA", TAPPI Seminar Notes, pp. 137–142, 1986.

H. Sommer "Applicating Systems for Coating ULWC and MFP Papers", Tappi Proceedings, pp. 131–137, 1988 Coating Conference.

C. K. Aidun, "Principles of Hydrodynamic Instability Application in Coating Systems", Tappi Journal, vol. 74, No. 3, pp. 213–220, Mar., 1991.

N. G. Triantafillopoulos and C. K. Aidun, "Relationship between flow instability in short-dwell ponds and cross directional coat weight nonuniformities", reprinted from *Tappi Journal*, vol. 73, No. 6, pp. 127–136, Jun. 1990.

*Primary Examiner*—W. Gary Jones
*Assistant Examiner*—Brenda Adele Lamb
*Attorney, Agent, or Firm*—Fitch, Even, Tabin & Flannery

[57] ABSTRACT

The present invention is directed to a coating device for application of coating material to the surface of a web or a flexible substrate. The coating device contains a pressurized channel where a flowing stream of the coating liquid first comes into contact with the substrate. The coating liquid enters the channel at the upstream side and wets the substrate as it flows in the same direction as the substrate. A doctor element is positioned at the downstream side of the channel where the excess coating in the channel follows the contour of the boundary formed by the doctor element and leaves the channel. The geometry of the streamlined boundaries of the coating device eliminate the formation of recirculating eddies or vortices. The elimination of vortices eliminates flow instability due to centrifugal forces and removes harmful pressure fluctuations which could result in coat-weight nonuniformities. The elimination of recirculating eddies or vortices also removes the possibility of entrapping air pockets or air bubbles in the core of the vortices which could reach the blade gap and could result in coat-weight nonuniformities and wet streaks.

2 Claims, 2 Drawing Sheets

COATING DEVICE FOR TRAVELING WEBS

CROSS-REFERENCE TO RELATED APPLICATION

This application is a continuation-in-part of application Ser. No. 849,530 filed Mar. 11, 1992 now abandoned.

FIELD OF THE INVENTION

The present invention relates generally to a coating device for uniform coating of a traveling web of material. More particularly, the present invention relates to a short-dwell coater which eliminates the captive pond associated with short dwell coaters and provides the coating material in the form of a flowing stream of coating material which flows in the same direction as the web movement.

BACKGROUND OF THE INVENTION

One of the most significant changes in light weight coated (LWC) paper production is the use of the short-dwell coater. The short-dwell coater has enabled the paper maker to improve productivity while maintaining coated paper quality. The term "short-dwell" refers to the relatively short period of time that the coating is in contact with a web of paper material before the excess is metered off by a trailing doctor blade. As shown in FIG. 1, prior art short-dwell coaters consist of a captive pond 21 just prior to the doctor blade 23. The pond is approximately 5 cm in length and is slightly pressurized to promote adhesion of the coating to the paper web 25. The excess coating supplied to the sheet creates a backflow of coating 27. This coating backflow excludes to some extent the boundary layer of air entering with the sheet and eliminates skip coating. The excess coating is channeled over an overflow baffle 29 and collected in a return pan before returning to tanks to be screened.

While short-dwell coaters are extensively used in coating paper webs, such coators suffer from a major problem. The flow in the coating chamber of the pond upstream of the doctor blade contains recirculating eddies or vortices which can result in coat-weight nonuniformities and wet streaks or striations in several ways. For example, these eddies can become unstable due to centrifugal forces and result in the generation of unsteady flow and rapidly fluctuating vortices, which deteriorate the coating uniformity and its quality. Also, the vortices tend to entrap small air bubbles which result in the buildup of relatively large air inclusions in the coating liquid which tend to accumulate in the core region of the eddies. Vortex fluctuations tend to force these air inclusions into the blade gap. This adversely affects the coating quality. Usually, the presence of air inclusions results in regions of lower coat weight which are 2–4 cm wide and about 10–100 cm long, known in the industry as "wet streaks". These problems are discussed in an article "Principles of Hydrodynamic Instability: Application in Coating Systems", C. K. Aidun, Tappi Journal, Vol. 74, No. 3, March, 1991.

It would be desirable to provide a coating device which has the coating advantages of a short-dwell coater, but which did not have the problems associated with recirculating eddies or vortices and the entrapment of air pockets or air bubbles in the core of the vortices.

Accordingly, it is a principal object of the present invention to provide a vortex free short-dwell coating device.

These and other objects will become more apparent from the following description and the appended claims.

SUMMARY OF THE INVENTION

The present invention is directed to a coating device for application of coating material to the surface of a web or a flexible substrate. The coating device contains a pressurized channel where a flowing stream of the coating liquid first comes into contact with the substrate. The coating liquid enters the channel at the upstream side and wets the substrate as it flows in the same direction as the substrate. A doctor element is positioned at the downstream side of the channel where the excess coating in the channel follows the contour of the boundary formed by the doctor element and leaves the channel. The geometry of the streamlined boundaries of the coating device eliminate the formation of recirculating eddies or vortices. The elimination of vortices eliminates flow instability due to centrifugal forces and removes harmful pressure fluctuations which could result in coat-weight nonuniformities. The elimination of recirculating eddies or vortices also removes the possibility of entrapping air pockets or air bubbles in the core of the vortices which could reach the blade gap and could result in coat-weight nonuniformities and wet streaks.

DETAILED DESCRIPTION OF THE INVENTION

Figure 1:
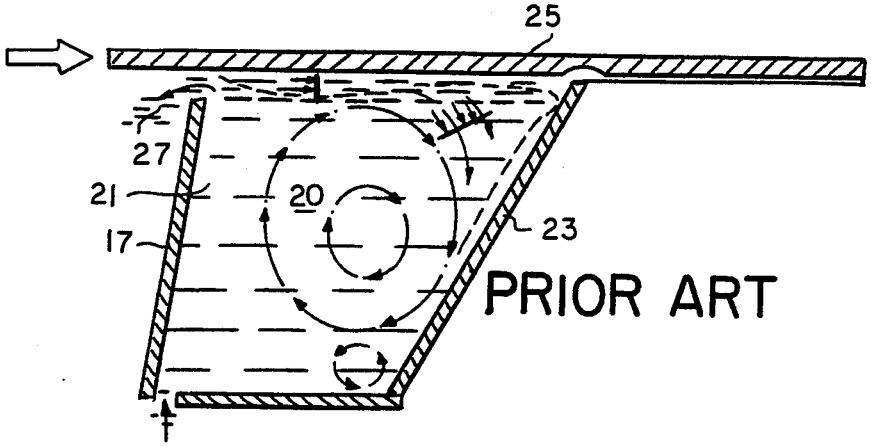
FIG. 1 is a schematic cross-sectional view of a prior art short-dwell coating device.
Figure 2:
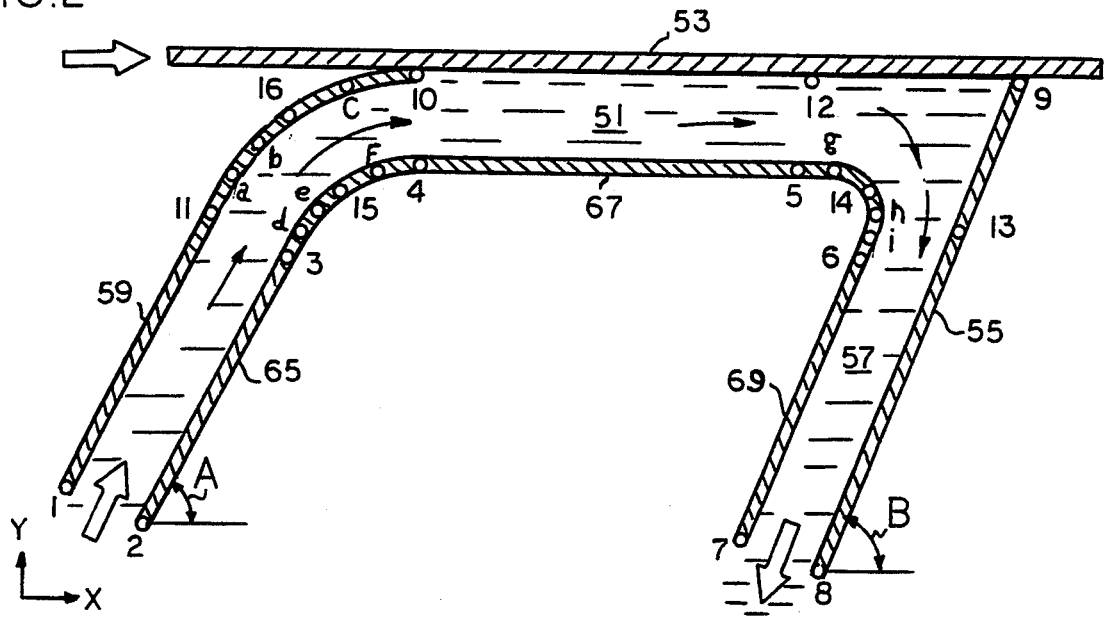
FIG. 2 is a schematic cross-sectional view of a short-dwell coating device in accordance with the present invention.

As shown in FIG. 2, the short-dwell coating device of the present invention consists of a continuous channel of coating material which passes through a coating chamber 51 which is in contact with a web 53 of material which is to be coated. The coating device comprises straight and curvilinear wall sections. For purposes of orientation and discussion, the coating chamber has an upstream side and a downstream side with respect to movement of the web with the upstream side being to the left of FIG. 1. The use of the terms "horizontal" and "vertical" are with respect to a horizontal orientation of the web. The web, however, is usually supported on a counter roll and has a slight curvature in the region of the coating chamber.

The coating device includes a doctor element 55 which is spaced from the web for defining the thickness of the coating on the web. The doctor element 55 extends across the web transversely to the direction of the web motion. The doctor element also forms a downstream boundary wall of the coating chamber 51 and extends downwardly for a further distance to define the downstream wall of an exit plenum 57.

An upstream boundary wall 59 defines the upstream side of the coating chamber 51. The upstream boundary wall 59 extends downwardly for a further distance to define the upstream side of an entrance plenum 61. The upstream boundary wall 59 terminates at its uppermost end in contact with the web 53. As shown in FIG. 2, the terminal end of the upstream boundary wall 59 preferably has a curvilinear shape so that the terminus of the upstream boundary wall 59 is substantially tangential to the web 53. The upstream boundary wall 59 also extends across the web transversely to the direction of the web motion.

A continuous interior wall which also extends across the web transversely to the direction of web motion, has discrete sections, which in combination with the upstream boundary wall 59, the web 53 and the doctor element 55, define the entrance plenum 61, the coating chamber 51 and the exit plenum 57, respectively. The first section 65 of the interior wall defines the downstream side of the entrance plenum 61. The first interior wall section 65 is preferably substantially parallel to the upstream boundary wall 59. The first interior wall section 65 preferably undergoes a curvilinear transition to a second interior wall section 67. The second interior wall section 67 defines the bottom wall of the coating chamber 51. The second interior wall section 67 proceeds to a third interior wall section 69, preferably through a curvilinear transition section. The third interior wall section 69 defines the upstream side of the exit plenum 57. Both the second interior wall section 67 and the third interior wall section 69 are preferably substantially parallel to the web and the doctor element 55, respectively.

The upstream boundary wall 59 preferably terminates in a curvilinear section which is substantially parallel to the curvilinear transition section between first interior wall section 65 and second interior wall section 67. The terminal end of the upstream boundary wall 59 is also preferably biased against the web 53 to prevent any coating material from being forced between the terminal end of the upstream boundary wall and the web 53 and to prevent air from entering into the coating material. The biasing may be accomplished through the use of any suitable means, such as by use of a spring or a flexible material.

Figure 4:
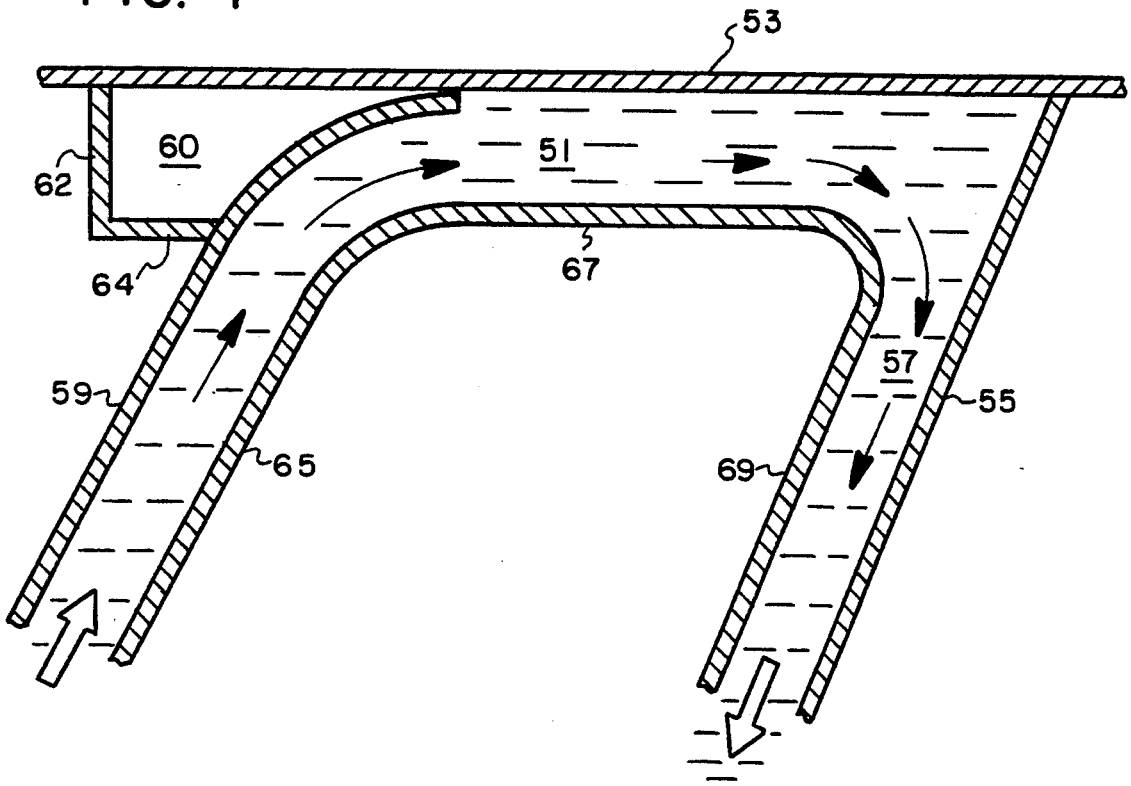
FIG. 4 is a schematic cross-section of a further embodiment of the short-dwell coating device in accordance with the present invention.

As shown in FIG. 4, a vacuum box 60 can be provided to further ensure that no air will become entrained in the coating material. When a vacuum is established in vacuum box 60, the air pressure near the wetting line is reduced, thereby increasing the biasing effect on the boundary wall 59 and preventing any air inclusion at high speeds. The vacuum box 60 is defined by the web 53, the upstream boundary wall and by walls 62 and 64 which extend across the web transversely to the direction of web motion. The outward ends of the vacuum box are capped and one of these ends is fitted to a vacuum source (not shown).

The walls forming the entrance plenum 61 may be vertical at a right angle to web 53. The entrance plenum walls, however, are preferably upwardly inclined in a direction toward the downstream side. The angle A of inclination of the entrance plenum is preferably in the range of from about 10° to about 90°, most preferably about 45°. The walls forming the exit plenum 57 may also be vertical, but are preferably inclined downwardly in a direction toward or away from the upstream side of the exit plenum. The angle B of inclination of the exit plenum is preferably in the range of from about 20" to about 175°, most preferably about 63°.

As an example of construction of the coating device of the present invention, various spatial nodes have been designated in the various walls of the coating device with the numbers 1 through 16. These nodes are identified in the table below with spatial displacements from node 1 in terms of X and Y coordinates. Curve points a through i have also been designated with X and Y coordinates.

TABLE 1

| Node # | X(mm) | Y(mm) | Curve Points | X(mm) | Y(mm) |
|---|---|---|---|---|---|
| 1 | 0 | 0 | a | 32 | 32 |
| 2 | 3.536 | −3.536 | b | 35 | 34 |
| 3 | 34 | 27 | c | 45 | 39 |
| 4 | 52 | 35 | d | 36 | 29 |
| 5 | 85 | 35 | e | 40 | 31.5 |
| 6 | 91 | 25 | f | 47 | 34 |
| 7 | 76.555 | −4.7 | g | 88 | 34 |
| 8 | 81 | −7 | h | 91 | 30 |
| 9 | 105 | 40 | i | 91.5 | 27 |
| 10 | 52 | 40 | | | |
| 11 | 30 | 30 | | | |
| 12 | 85 | 40 | | | |
| 13 | 98 | 26 | | | |
| 14 | 90 | 32 | | | |
| 15 | 43 | 33 | | | |
| 16 | 40 | 37 | | | |

Figure 3:
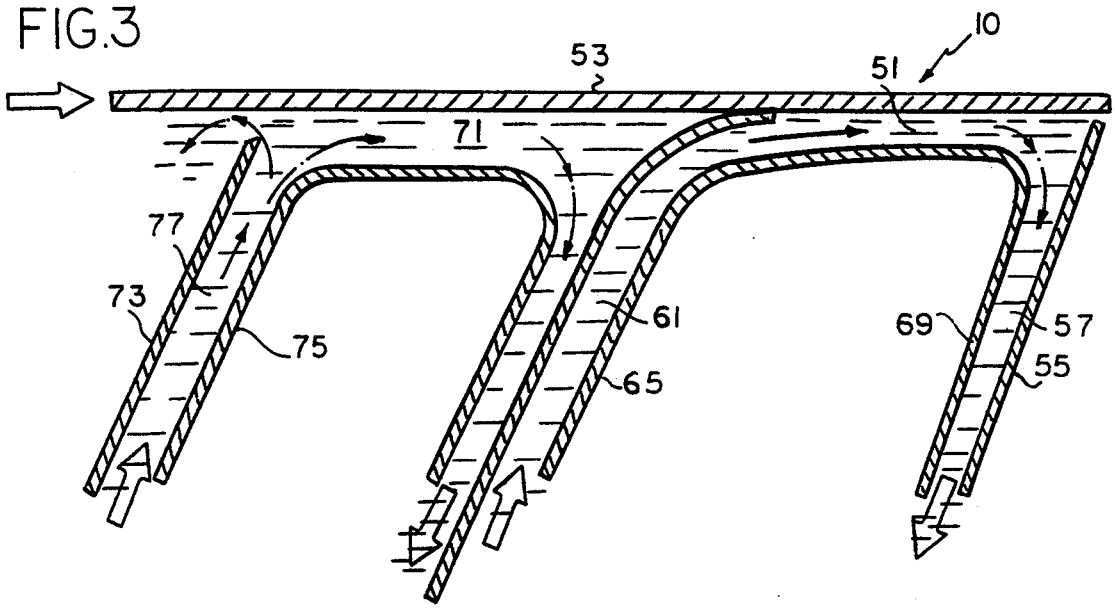
FIG. 3 is a schematic cross-sectional view of another embodiment of the short-dwell coating device in accordance with the present invention.

In another embodiment of the invention, as shown in FIG. 3, a pre-coating chamber 71 is provided on the upstream side of the short-dwell coating device of the invention. The downstream boundary wall of the pre-coating chamber is formed from the upstream boundary wall 59 of the coating device 10. A downstream wall 73 is spaced from web 53 by a distance of from about 1 to about 5 mm to provide an overflow baffle for coating material to prevent entrance of air in the manner used by prior art short-dwell coaters. The continuous interior wall 75 is used to define an entrance plenum 77, the pre-coating chamber 71 and an exit plenum 79 in the same fashion and with the same parameters as previously described for the coating device.

While various aspects of the invention have been described with particularity, various modifications and alterations to the coating device can be made without departing from the scope of the invention as defined in the appended claims.

What is claimed is:

1. A coating device for coating a traveling web of material comprising:

(a) a web of material which is guided for movement past the coating device;

(b) a doctor element spaced from said web for defining the thickness of a coating on said web, the doctor element extending across said web transversely of the direction of said web motion;

(c) means defining a coating composition application chamber also extending across said web transversely of the direction of said web motion, the chamber having upstream and downstream sides with respect to movement of said web, said doctor element defining a downstream boundary wall of said chamber, said means including an interior wall and an upstream boundary wall terminating in contact with said web, said interior wall and said upstream wall also extending across the web transversely of the direction of web motion;

(d) said doctor element, said interior wall and said upstream boundary wall, in combination, defining in successive fluid communication;

(i) an entrance plenum for receiving a moving stream of a liquid coating material;

(ii) a coating chamber adjacent said web for transporting said moving stream of liquid coating material in contact with said web and in the same direction as the direction of said web motion; and (iii) an exit plenum for discharge of said moving stream of coating material, said entrance plenum being spaced from said exit plenum by the length of the coating chamber;

(e) said interior wall comprising in cross-section an upstream side wall spaced from and parallel to said upstream boundary wall to define said entrance plenum, a top wall spaced from and parallel to said web to define said coating chamber and a downstream wall spaced from and parallel to said doctor element to define said exit plenum, the junction of said upstream wall and said downstream wall of said interior wall with said top of said interior wall being curvilinear and substantially parallel defining a curvilinear path therebetween;

(f) means defining a pre-coating composition application chamber also extending across said web transversely of the direction of said web motion, the pre-coating chamber having upstream and downstream sides with respect to movement of said web, said upstream wall of said coating chamber defining a downstream boundary wall of said pre-coating chamber, said means including a second interior wall and a second upstream boundary wall terminating in spaced relationship with said web to provide an overflow baffle, said second interior wall and said second upstream wall also extending across the web transversely of the direction of web motion; and (g) said second upstream wall, said second interior wall of said pre-coating chamber and said upstream boundary wall of said coating chamber, in combination, defining in successive fluid communication;

(i) a second entrance plenum for receiving a moving stream of a liquid coating material;

(ii) a pre-coating chamber being adjacent said web for transporting said moving stream of liquid coating material in contact with said web through said overflow baffle and in the same direction as the direction of said web motion; and (iii) a second exit plenum for discharge of said moving stream of coating material, said second entrance plenum being spaced from said second exit plenum by the length of said pre-coating chamber.

2. A coating device in accordance with claim 1 wherein said second upstream wall of said pre-coating chamber terminates at a distance of from about 1 to about 5 mm from said web.

* * * * *

UNITED STATES PATENT AND TRADEMARK OFFICE

CERTIFICATE OF CORRECTION

PATENT NO. : 5,366,551

DATED : November 22, 1994

INVENTOR(S) : Cyrus K. Aidun

It is certified that error appears in the above-identified patent and that said Letters Patent is hereby corrected as shown below:

Column 1, line 4, insert the following paragraph:

--This invention was made with Government support under National Science Foundation Grant Number CTS-9258667 awarded by the National Science Foundation. The Government has certain rights in this invention.--

Signed and Sealed this

Twenty-seventh Day of July, 1999

*Attest:*

Q. TODD DICKINSON

*Attesting Officer*

*Acting Commissioner of Patents and Trademarks*